US007040410B2

(12) United States Patent
McGuire et al.

(10) Patent No.: US 7,040,410 B2
(45) Date of Patent: May 9, 2006

(54) ADAPTERS FOR DOUBLE-LOCKING CASING MANDREL AND METHOD OF USING SAME

(75) Inventors: Bob McGuire, Oklahoma City, OK (US); L. Murray Dallas, Fairview, TX (US)

(73) Assignee: HWC Energy Services, Inc., Houston, TX (US)

( * ) Notice: Subject to any disclaimer, the term of this patent is extended or adjusted under 35 U.S.C. 154(b) by 26 days.

(21) Appl. No.: 10/617,099

(22) Filed: Jul. 10, 2003

(65) Prior Publication Data

US 2005/0006103 A1 Jan. 13, 2005

(51) Int. Cl.
*E21B 19/16* (2006.01)

(52) U.S. Cl. ..... 166/379; 166/85.4; 166/75.14

(58) Field of Classification Search ..... 166/76.1, 166/77.51, 379, 85.4, 75.14, 382; 285/123.3, 285/124.4, 124.5, 408, 412–414, 353, 354
See application file for complete search history.

(56) References Cited

U.S. PATENT DOCUMENTS 1,869,739 A * 8/1932 Dean et al. ..... 285/123.4
2,083,090 A * 6/1937 Rector ..... 166/76.1
3,343,603 A 9/1967 Miller
3,675,719 A 7/1972 Slator et al.
4,353,420 A 10/1982 Miller
4,923,006 A * 5/1990 Hartmann et al. ..... 166/65.1
4,993,488 A 2/1991 McLeod
5,092,401 A 3/1992 Heynen
5,605,194 A 2/1997 Smith
5,611,398 A * 3/1997 Duhn et al. ..... 166/75.11
5,660,234 A 8/1997 Hebert et al.
5,927,403 A 7/1999 Dallas ..... 166/77.51
6,179,053 B1 1/2001 Dallas (Continued)

OTHER PUBLICATIONS

U.S. Appl. No. 10/336,911, entitled "Backpressure Adapter Pin and Methods of Use," filed Jan. 6, 2003.

(Continued)

*Primary Examiner*—Kenneth Thompson
(74) *Attorney, Agent, or Firm*—Nelson Mullins Riley & Scarborough, LLP

(57) ABSTRACT

Adapters for connecting to a double-locking casing mandrel of an independent screwed wellhead include a lockdown flange with an adapter pin, and a retainer flange that may be used with or without the adapter pin. The retainer flange has a top surface with circumferentially-spaced threaded bores that permit well stimulation equipment to be mounted thereto. The retainer flange threadedly connects to a pin thread at a top of the casing mandrel, and therefore provides a low profile mounting flange for well stimulation equipment.

25 Claims, 8 Drawing Sheets

U.S. PATENT DOCUMENTS

| | | | | |
|---|---|---|---|---|
| 6,196,323 | B1 | 3/2001 | Moksvold | |
| 6,220,363 | B1 | 4/2001 | Dallas | 166/382 |
| 6,247,537 | B1 | 6/2001 | Dallas | |
| 6,289,993 | B1 | 9/2001 | Dallas | 166/386 |
| 6,364,024 | B1 | 4/2002 | Dallas | |
| 6,491,098 | B1 | 12/2002 | Dallas | |
| 6,626,245 | B1 | 9/2003 | Dallas | 166/379 |
| 6,695,064 | B1 | 2/2004 | Dallas | 166/382 |
| 6,769,489 | B1 | 8/2004 | Dallas | 166/386 |
| 6,817,421 | B1 | 11/2004 | Dallas | 166/379 |
| 6,817,423 | B1 | 11/2004 | Dallas | 166/382 |
| 6,827,147 | B1 | 12/2004 | Dallas | 166/379 |

OTHER PUBLICATIONS

U.S. Appl. No. 10/440,795, entitled "Casing Mandrel with Well Stimulation Tool and Tubing Head Spool for Use with the Casting Mandrel," filed May 19, 2003.

U.S. Appl. No. 10/607,921, entitled "Multi-Lock Adapters for Independent Screwed Wellheads and Methods of Using Same," filed Jun. 27, 2003.

U.S. Appl. No. 10/912,894, entitled "Backpressure Adapter Pin and Methods of Use," filed Aug. 6, 2004.

* cited by examiner

ADAPTERS FOR DOUBLE-LOCKING CASING MANDREL AND METHOD OF USING SAME

CROSS-REFERENCE TO RELATED APPLICATIONS

This is the first application filed for the present invention.

MICROFICHE APPENDIX

Not Applicable.

TECHNICAL FIELD

The present invention relates generally to wellhead assemblies and, in particular, to adapters for double-locking casing mandrels of independent screwed wellheads, the adapters providing flanges for connection to well stimulation equipment.

BACKGROUND OF THE INVENTION

Independent screwed wellheads are well known in the art and classified by the American Petroleum Institute (API). The independent screwed wellhead has independently secured heads for each tubular string supported in the well bore. Independent screwed wellheads are widely used for production from low-pressure productions zones because they are economical to construct and maintain.

It is well known in the art that low pressure wells frequently require some form of stimulation to improve or sustain production. Traditionally, such stimulation procedures have involved pumping high pressure fluids down the casing to fracture production zones. The high pressure fluids are often laden with proppants, such as bauxite and/or sharp sand.

FIG. 1 illustrates a prior art independent screwed wellhead 20 equipped with a flanged casing pin adaptor 30 typically used for completing or re-completing a well equipped with an independent screwed wellhead 20. The independent screwed wellhead 20 is mounted to a surface casing (not shown). As is understood by those skilled in the art, the independent screwed wellhead 20 may have a screw connection, a welded connection, a clamped connection or a pin connection to the surface casing. The independent screwed wellhead 20 includes a sidewall 32 that terminates at a top end in a casing bowl 34, which receives a casing mandrel 36. The casing mandrel 36 has a bottom end 38, a top end 40 and an axial passage 42 having a diameter at least as large as a casing 44 in the well bore. The casing 44 has a pin thread 46 that engages a box thread 48 in the bottom end 38 of the casing mandrel 36. A flanged casing pin adaptor 30 has a pin thread 47 that engages a box thread 49 in the top end of the axial passage 42 in the casing mandrel 36. The flanged casing pin adaptor 30 also includes a top flange 45 to which a high pressure valve or a blowout preventor (BOP) is mounted, in a manner well known in the art.

In a typical well stimulation procedure, a casing saver (not shown), such as a casing packer as described in U.S. Pat. No. 4,993,488, which issued Feb. 19, 1991 to Macleod, is inserted through the BOP (not shown) and into the casing 44. The casing saver is sealed off against the casing 44 and high pressure fluids are injected through the casing saver into a formation of the well. While the casing saver protects the exposed top end of the casing 44 from "washout", it does not release the box thread 49 or the pin thread 47 from strain induced by the elevated fluid pressures generated by the injection of high pressure fracturing fluid into the well. In a typical fracturing operation, high pressure fluids are pumped into the well at around 9500 lbs per square inch (PSI). If "energized fluids" or high pumping rates at more than 50 barrels per minute are used, peak pressures can exceed 9500 PSI. In general, the threads retaining the flanged casing pin adaptor 30 in the casing mandrel 36 are engineered to withstand 7000 PSI, or less. Consequently, high pressure stimulation using the equipment shown in FIG. 1 can expose the flanged casing pin adaptor 30 to an upward pressure that exceeds the strength of the pin thread. If either the box thread 49 or the pin thread 47 fails, the flanged casing pin adaptor 30 and any connected equipment may be ejected from the well and hydrocarbons may be released to atmosphere. This is an undesirable and potentially dangerous situation.

Furthermore, use of a casing saver to perform well completion or re-completion slows down operations in a multi-zone well because the flow rates are hampered by the reduced internal diameter of the casing saver. Besides, the casing saver must be removed from the well each time the fracturing of a zone is completed to permit isolation plugs or packers to be set in order to isolate a next zone to be stimulated. It is well known in the art that the disconnection of fracturing lines and the removal of a casing saver is a time consuming operation that keeps expensive fracturing equipment and/or wireline equipment and crews sitting idle. It is therefore desirable to provide full-bore access to the well casing 44 in order to ensure that transitions between zones in a multi-stage fracturing process are accomplished as quickly as possible.

Applicant has developed an independent screwed wellhead that overcomes these problems by providing an external thread on a top end of a casing mandrel of the wellhead. The external, or "pin", thread is used for lock down connection of well stimulation components. The external thread permits a double-locking of a well stimulation tool to the wellhead, as is described in detail in co-pending, U.S. patent application Ser. No. 10/440,795 entitled CASING MANDREL WITH WELL STIMULATION TOOL AND TUBING HEAD SPOOL FOR USE WITH THE CASING MANDREL, which was filed on May 19, 2003, and is incorporated herein by reference. The well stimulation tool and casing mandrel provide full-bore access to a casing of the well, while significantly improving safety of a well stimulation crew by ensuring that a hold strength of equipment through which well stimulation fluids are pumped exceeds fluid injection pressures by an adequate margin.

While the casing mandrel of the co-pending application represents a significant advance in the art, there remains a need for lowering a height of the casing mandrel and the well stimulation tool, and for improving versatility of the combination.

SUMMARY OF THE INVENTION

It is therefore an object of the invention to provide an adapter for connecting well stimulation equipment to a double-locking casing mandrel of an independent screwed wellhead.

It is a further object of the invention to provide a low profile adapter for connecting well stimulation equipment to a double-locking casing mandrel of an independent screwed wellhead.

The invention therefore provides an adapter for mounting any one of a blowout preventer, a high pressure valve, and a well stimulation tool to a double-locking casing mandrel of an independent screwed wellhead. The adapter comprises an adapter pin, which is a hollow cylindrical body having a central passage, a top nipple section with a top pin thread, and a bottom nipple section with a bottom pin thread. The adapter pin may be used in combination with a lockdown flange having a top end to which the blowout preventer, the high pressure valve, or the well stimulation tool can be mounted; an axial passage having a box-threaded bottom end for receiving the top nipple section of the adapter pin and threadedly engaging the top pin thread thereof; and, a lockdown nut supported by an annular shoulder below the top end, the lockdown nut having a box thread for engaging a pin thread on the outer wall of a top end of the double-locking casing mandrel. The adapter pin may also be used in combination with a retainer flange for providing a mounting surface to which the any one of the blowout preventer, high pressure valve, and well stimulation tool can be mounted, the retainer flange having an annular flange with an axial passageway that is box-threaded for engaging a pin thread on a top end of the double-locking casing mandrel.

The top nipple section of the adapter pin comprises a sealing nipple located between the top and bottom pin threads on the adapter pin.

The sealing nipple comprises a smooth, cylindrical outer surface that mates with O-rings retained in grooves in a central passage through the one of the blowout preventer, the high pressure valve and the well stimulation tool.

The bottom nipple section of the adapter pin comprises a sealing nipple located between the top and bottom pin threads on the adapter pin.

The sealing nipple comprises a smooth, cylindrical outer surface that mates with O-rings retained in grooves in a central passage through the casing mandrel.

The invention further provides a method for stimulating a well equipped with a double-locking casing mandrel of an independent screwed wellhead. The method comprises sealingly connecting to the casing mandrel an adapter pin that comprises a hollow cylindrical body with an internal diameter at least as large as that of a casing supported by the casing mandrel, by thread-engaging rotation of a pin-threaded nipple section of the adapter pin with respect to a top end box thread of the casing mandrel; threadedly connecting a retainer flange to a pin thread on an outer wall of a top end of the casing mandrel; securing well stimulation equipment to the casing mandrel using a pin-treaded top end of the adapter pin, and box threaded bores in a top surface of the retainer flange for receiving flange bolts; and stimulating the well by pumping high pressure well stimulation fluids through the well stimulation equipment into the casing of the well.

The step of securing comprises rotating any one of a well stimulation tool, a blowout preventer, and a high pressure valve into connection with the pin-threaded top end, and then bolting the one of the well stimulation tool, blowout preventer, and high pressure valve to the top surface of the retainer flange.

The step of securing may comprise mounting a blowout preventer to the retainer flange, mounting a blowout preventer protector to the blowout preventer, and stroking the blowout preventer protector through the blowout preventer and into a secondary seal bore of the casing mandrel prior to stimulating the well.

The step of securing may further comprise mounting a high pressure valve above the blowout preventer and connecting high pressure fracturing lines to the high pressure valve to permit the high pressure well stimulation fluids to be pumped into the casing of the well.

An important advantage of the adapters in accordance with the invention is that they provide a low profile over the wellhead to facilitate well stimulation procedures and to thereby increase work safety.

BRIEF DESCRIPTION OF THE DRAWINGS

Further features and advantages of the present invention will become apparent from the following detailed description, taken in combination with the appended drawings, in which.

It should be noted that throughout the appended drawings, like features are identified by like reference numerals.

DETAILED DESCRIPTION OF THE PREFERRED EMBODIMENT

The invention provides adapters for double-lock connection of a casing mandrel to well stimulation equipment, such as: a well stimulation tool; a high pressure valve; or a blowout preventer. The invention provides a versatile adapter because an adapter pin can be used with either of a low-profile retainer flange or a lockdown flange, in dependence on a connection end of the well stimulation equipment. The adapters have a low profile to reduce overall height of the well stimulation equipment. The adapters may be used in several ways to quickly and safely stimulate a well.

Figure 1:
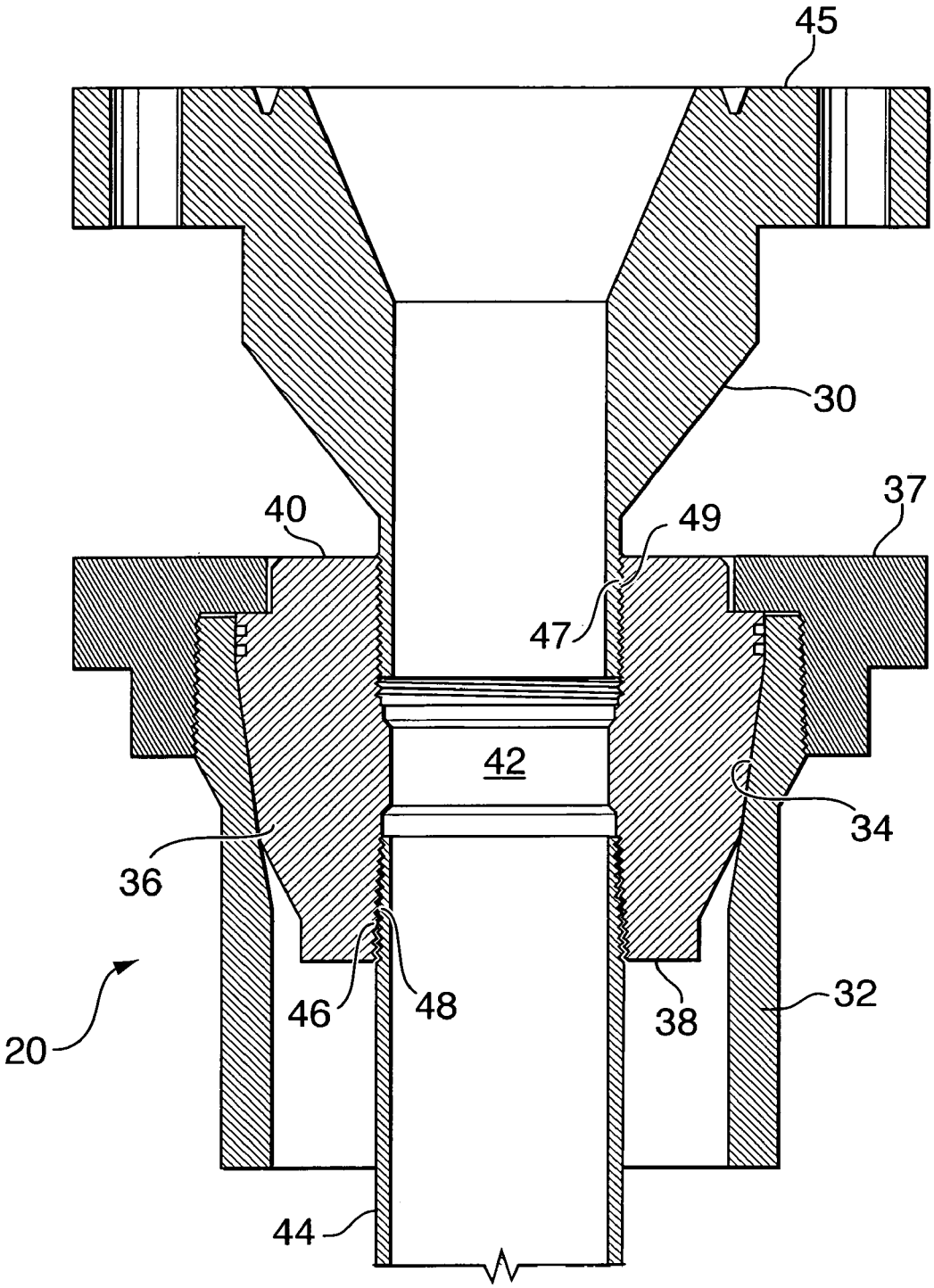
FIG. 1 PRIOR ART
FIG. 1 is a schematic cross-sectional view of an independent screwed wellhead equipped with a flanged casing pin adaptor, in accordance with the prior art.
Figure 2:
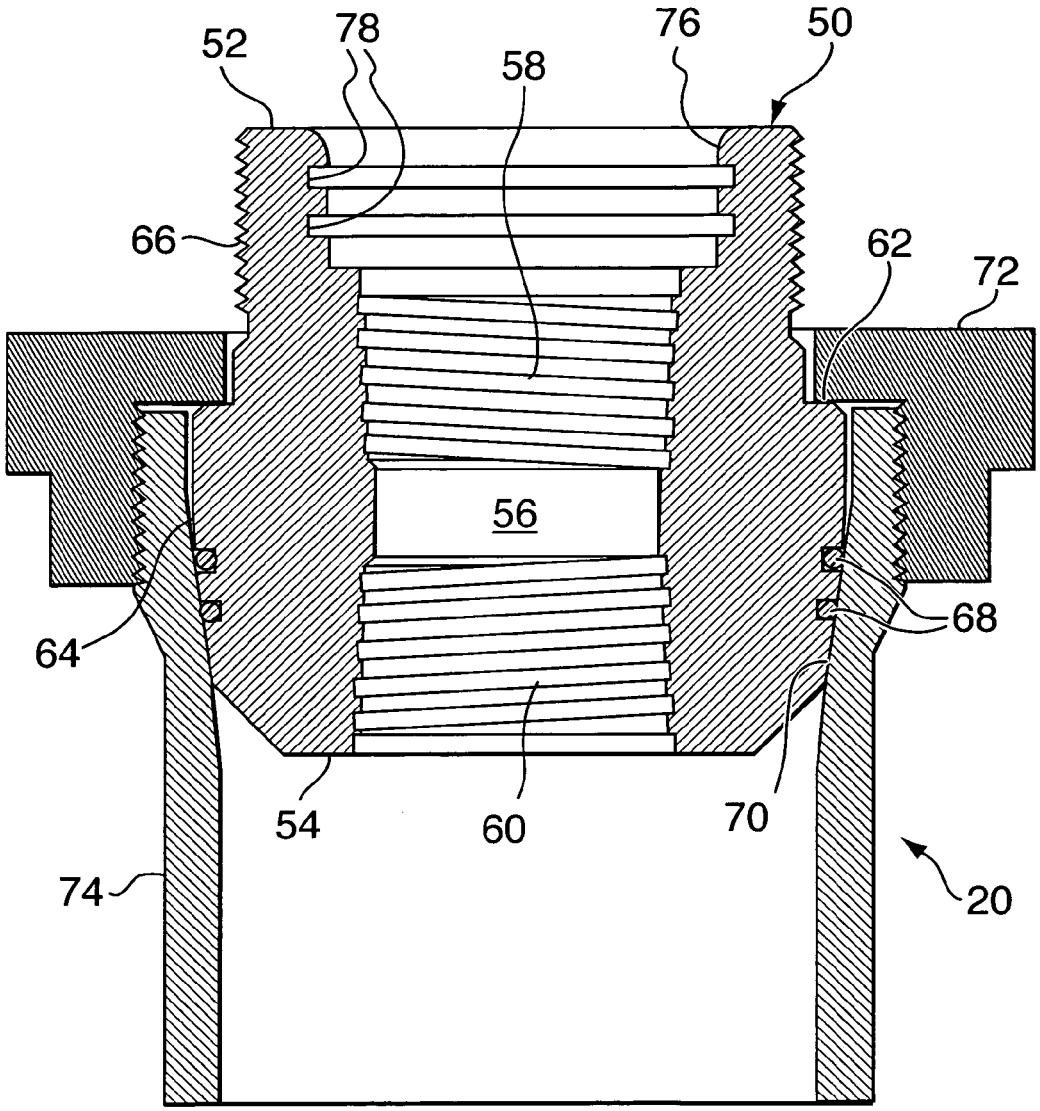
FIG. 2 is a schematic cross-sectional view of the independent screwed wellhead equipped with a casing mandrel described in Applicants' above-referenced pending patent application.

FIG. 2 schematically illustrates a double-locking casing mandrel 50 seated in an independent screwed wellhead 20, as taught in Applicants' above-identified co-pending United States patent application The double-locking casing mandrel 50 includes a casing mandrel top end 52 and a casing mandrel bottom end 54 with an axial passage 56 extending between the two. The axial passage 56 has a diameter at least at large as an internal diameter of a casing (not shown) supported by the casing mandrel 50. A top end of the axial passage 56 includes a top end box thread 58 and a bottom end of the axial passage 56 includes a bottom end box thread 60. A casing (not shown) having a complementary pin thread is threadedly connected to the casing mandrel bottom end 54, in a manner well known in the art.

The casing mandrel bottom end 54 includes a bottom exterior wall that forms an outer contour 64 shaped to mate with a contour of a casing bowl 70 formed in a cylindrical side wall 74 of the wellhead 20. The mating of the contours of the casing bowl 70 and casing mandrel 50 permits seating of the casing mandrel 50 within the wellhead 20. At least one annular groove 68 provides an annular seal retainer in the casing mandrel 50 to captively hold an elastomeric seal, such as an O-ring, to provide a fluid-tight seal between the outer contour 64 of the casing mandrel 50 and an inner surface of the casing bowl 70. The casing mandrel 50 further includes an annular shoulder 62 for supporting a casing bowl nut 72. The casing bowl nut 72 and annular shoulder 62 permit the securing of the casing mandrel 50 to be secured in the casing bowl 70.

The casing mandrel 50 further includes a pin thread 66 on an outer periphery of the casing mandrel top end 52. The pin thread 66 provides a point of attachment for a lockdown nut, permitting a well stimulation tool, or a blowout preventer, high pressure valve, or the like, to be double-locked to the casing mandrel 50, as will be explained below in detail. The axial passage 56 includes a secondary seal bore 76 above, and coaxial with, the top end box thread 58. The secondary seal bore 76 provides at least one annular groove 78 for receiving an elastomeric O-ring seal, or the like. The secondary seal bore 76 provides a high pressure fluid-tight seal with an adapter pin, as will also be explained below in detail.

Figure 3:
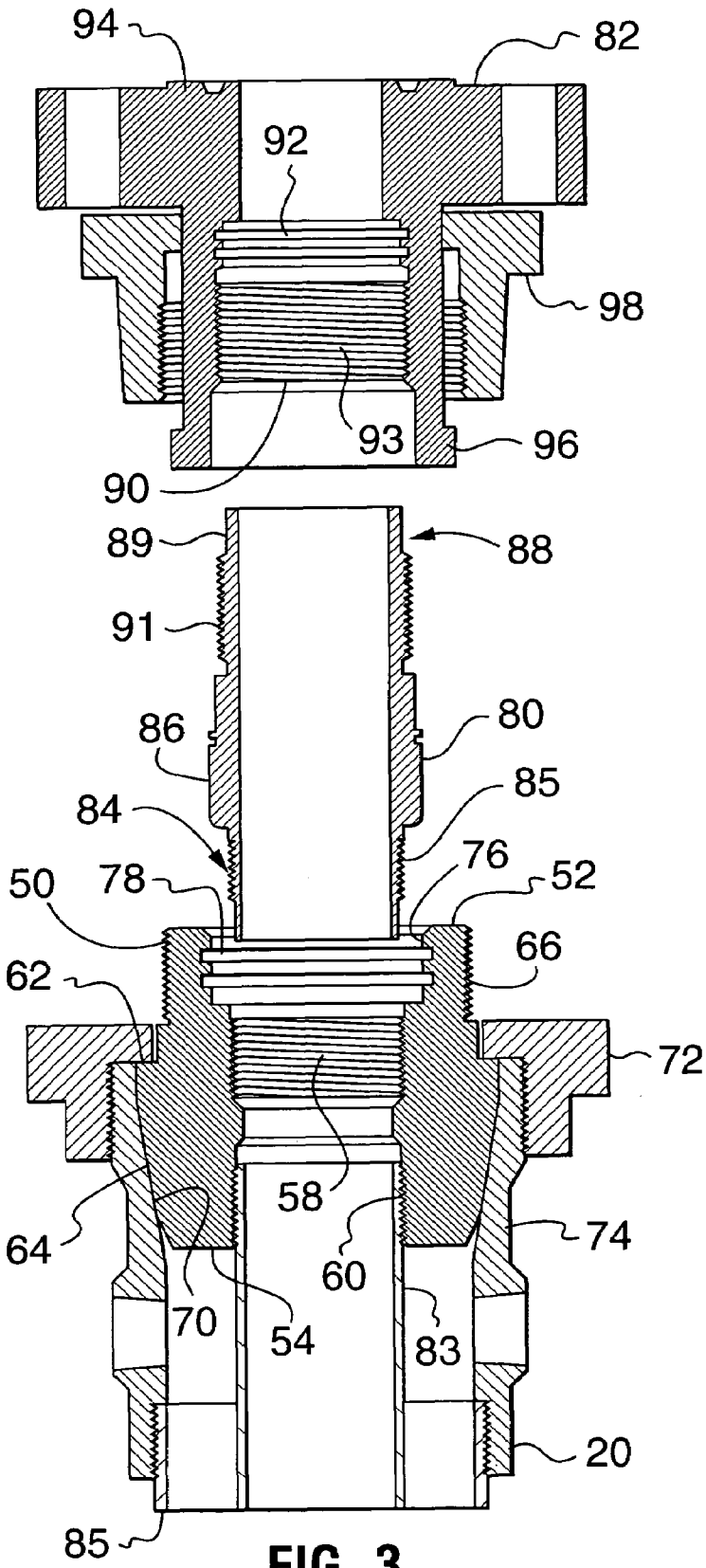
FIG. 3 is a partially-exploded schematic cross-sectional view of a versatile flanged adapter in accordance with an embodiment of the invention.

FIG. 3 is an exploded, cross-sectional schematic view of an adapter pin 80, and lockdown flange 82 that permit a secure direct or indirect connection of well stimulation equipment to the double-locking casing mandrel 50 shown in FIG. 2. As shown in FIG. 3, a casing 83, referred to above, is connected to the bottom end box thread 60 of the casing mandrel 50, and the wellhead 20 is connected to a surface casing 85.

The adapter pin 80 is a hollow cylindrical body having a central passage of a diameter equal to the internal diameter of the casing 83, and thereby extends the axial passage of the well when installed. The adapter pin 80 has two nipple sections: a top nipple section 88 having a top pin thread 91 for connection to the lockdown flange 82; and a bottom nipple section 84 for insertion into the top end 52 of the casing mandrel 50, having a bottom pin thread 85 for threaded engagement with the top end box thread 58 of the casing mandrel 50.

The length of the pin thread 85 on the bottom nipple section 84 preferably matches the length of the top end box thread 58 of the casing mandrel 50, so that all of the top end box thread 58 is protected by the bottom nipple section 84, when it is installed in the casing mandrel 50. A sealing nipple 86 of the bottom nipple section 84 has an outer diameter that is equal to an inner diameter of the secondary seal bore 76. Consequently, the O-ring seals in the annular grooves 78 cooperate with the sealing nipple 86 to provide a fluid-tight connection between the adapter pin 80, and the double-locking casing mandrel 50.

The profile of the top nipple section 88 is complementary to that of a box-threaded bottom end 90 of an axial passage through the lockdown flange 82. The top nipple section 88 has a sealing nipple 89 with a smooth outer wall that bears against at least one elastomeric seal received in an annular seal retainer groove (i.e. annular grooves 92 of the box-threaded bottom end 90 of the lockdown flange 82) to provide a fluid-tight seal between the adapter pin 80 and the lockdown flange 82. Top pin threads 91 of the adapter pin 80 engage box threads 93 of the lockdown flange 82 to provide a first lock between the casing mandrel 50 and the lockdown flange 82.

The lockdown flange 82 is an annular piece having a flanged top end 94. The top end 94 provides a standard flange or stud pad that permits substantially any well stimulation flow control equipment known in the art to be safely mounted to the screwed independent wellhead 20. An annular shoulder 96 rotatably supports a lockdown nut 98. The lockdown nut 98 is retained between the annular shoulder 96 and the bottom of the flanged top end 94, and rotates independently of the lockdown flange 82. The lockdown nut 98 is box-threaded for engagement with the pin thread 66 on the top end of the double-locking casing mandrel 50.

In order to stimulate a well to which the double-locking casing mandrel 50 of the independent screwed wellhead 20 is mounted, the bottom nipple section 84 of the adapter pin 80 is connected to the top end box thread 58 of the casing mandrel 50, by thread-engaging rotation. The lockdown flange 82 is then connected to the top nipple section 88 of the adapter pin 80 by similar rotation to engage the box threads 93 of the bottom end 90 and the pin thread 91 of the top nipple section 88 of the adapter pin 80. The lockdown nut 98 is then secured to the pin thread 66 of the casing mandrel 50. The well stimulation equipment to be used for well completion is then mounted to the flange at the top end 94 of the lockdown flange 82, and the well stimulation fluids are pumped into the well.

Figure 4A:
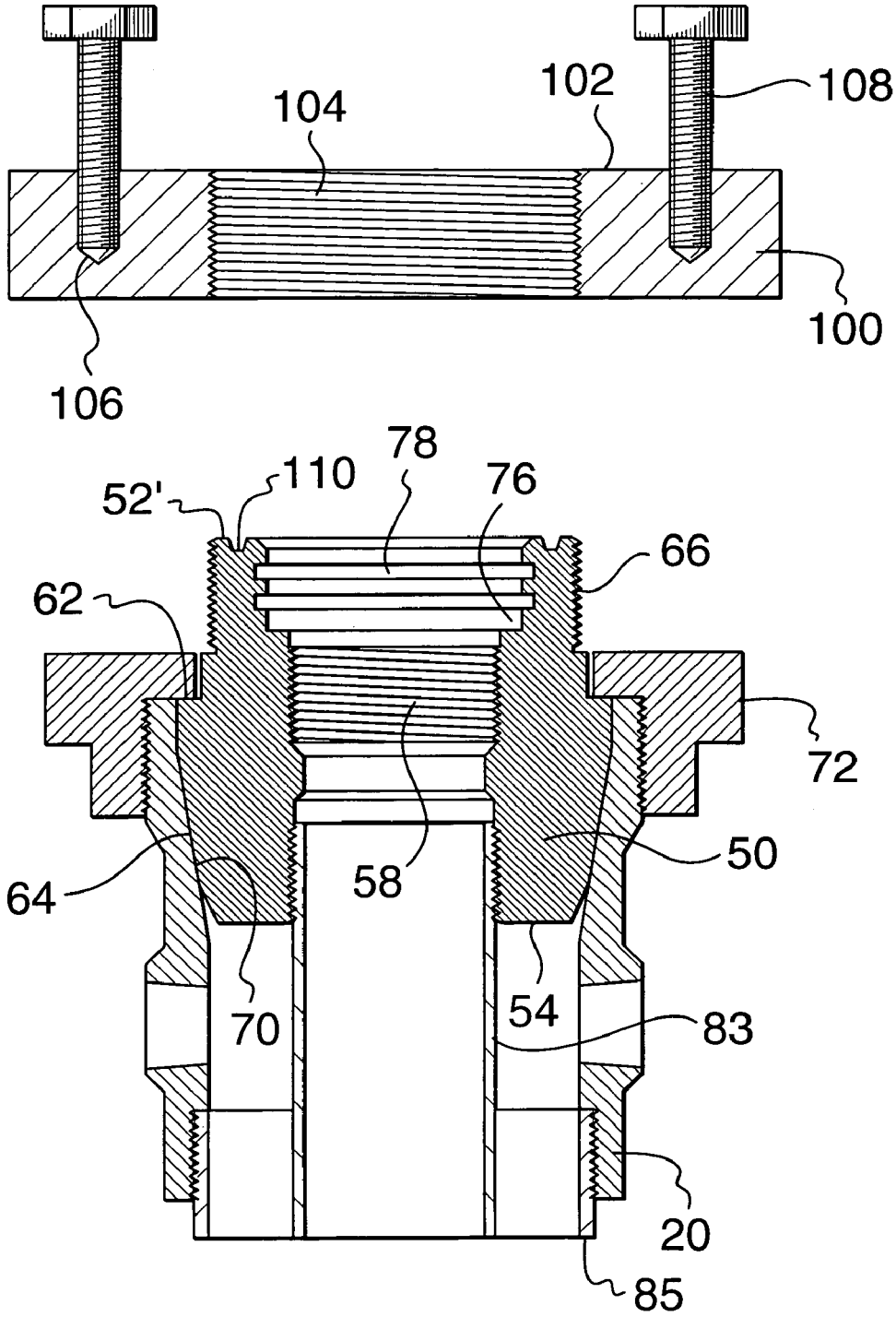
FIG. 4*a* is a partially-exploded schematic cross-sectional view of a low-profile retainer flange in accordance with an embodiment of the invention.

FIG. 4*a* schematically illustrates a retainer flange 100 in exploded view with the double-locking casing mandrel 50 of the independent screwed wellhead 20. Each illustrated component that was described above is identified using the same reference numeral, and is not described again. The retainer flange 100 has a top surface 102, and a bottom surface, with an axial passage 104 that extends between the top and bottom surfaces. The axial passage 104 is box-threaded to engage the pin thread 66 on the top end of the double-locking casing mandrel 50, to permit a solid coupling between the retainer flange 100 and the casing mandrel 50 when assembled.

The top surface 102 is a stud pad having circumferentially spaced threaded bores 106 for receiving studs 108. The retainer flange 100 can be used for a low-profile connection of a BOP, a high pressure valve, or a well stimulation tool directly to the casing mandrel 50. The casing mandrel top end 52' shown in FIG. 4*a* includes an annular groove 110 for supporting a flange gasket. The annular groove 110 may provide a sealed connection between the casing mandrel 50 and the BOP, high pressure valve, or well stimulation tool.

Figure 4B:
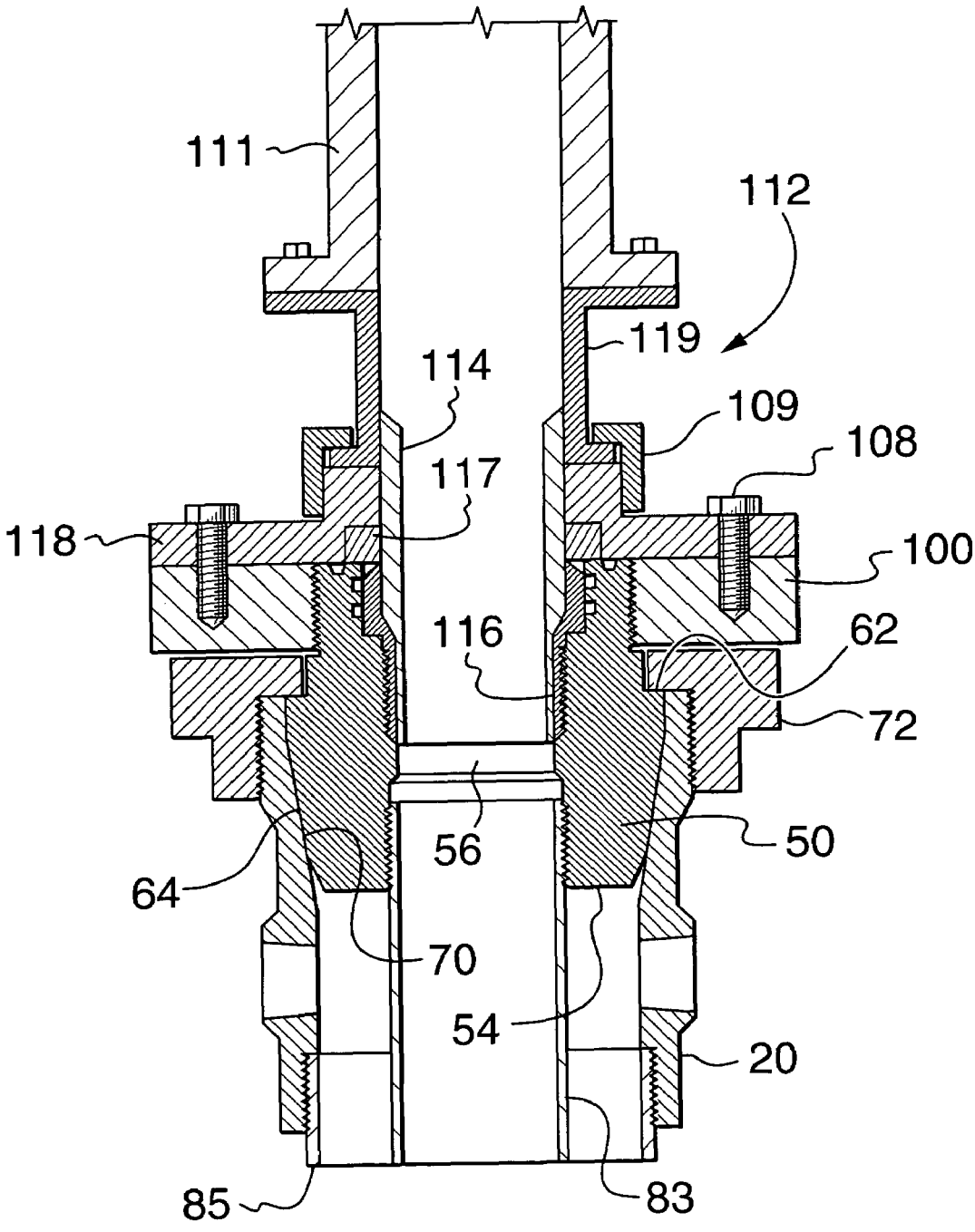
FIG. 4*b* is a schematic cross-sectional view of the retainer flange shown in FIG. 4*a*, supporting a connection to well stimulation equipment.

As schematically illustrated in FIG. 4*b*, the adapter flange 100 shown in FIG. 4*a* can be used in certain circumstances to mount a BOP protector 112, described in co-Applicant's U.S. Pat. No. 6,364,024, entitled BLOWOUT PREVENTER PROTECTOR AND METHODS OF USING SAME which issued on Apr. 2, 2002, the specification of which is incorporated herein by reference, directly to the independent screwed wellhead 20. In most cases, a blowout preventer (BOP, not shown) or some other flow control equipment is connected to the retainer flange 100, below the BOP protector 112, especially if there is any natural pressure in the well. Accordingly, the BOP protector 112 may be mounted to a top of a BOP as described in the above-referenced U.S. Pat. No. 6,364,024. A mandrel 114 of the BOP protector 112 is stroked down through an axial passage of the BOP, and an annular sealing body 116 on the bottom end of the mandrel 114 seals off against the secondary seal bore 76 of the double-locking casing mandrel 50. The annular sealing body 116 is bonded directly to a bottom end of the mandrel 114. The annular sealing body 116 provides a high pressure seal against the wall of the secondary seal bore 76 (FIG. 4*a*). A base member 118 includes a flange for connection to the retainer flange 100, using studs 108. An annular cavity surrounds a bottom of an axial passage for retaining a chevron packing 117. A pin-threaded top end of the base member 118 permits a lockdown nut 109 of a mandrel head 119 to be secured to the base member 118. A fracturing head 111, only partially shown, provides flow control and a connection point for high pressure lines (not shown). The mandrel head 119 includes a top flange for connection of the fracturing head 111, or other stimulation equipment, an outer wall having an annular shoulder for supporting the lockdown nut 109, and an axial passage including a box-threaded bottom end for threaded coupling with a top end of the mandrel 114.

Stimulating a well with the adapter shown in FIGS. 4*a,b* involves connecting the retainer flange 100 to the external thread 66 of the casing mandrel 50, and securing the BOP or any other flow control equipment, if required, to the wellhead. The BOP protector 112 is then installed by stroking the mandrel 114 down through an axial passage of the BOP and/or flow control equipment, until it is packed off against the secondary seal bore 76 of the casing mandrel 50. After the mandrel 114 is packed off against the secondary seal bore 76, well stimulation fluids can be pumped into the well.

The BOP protector provides full-bore access to the casing 83, and permits a tubing string to be suspended in the well during a well stimulation procedure. As described in the U.S. Pat. No. 6,364,024 the tubing string can be run through the BOP protector into or out of a live well at any time, and if a tubing string is not in the well, any downhole tool can be run into or out of the casing 83.

If stimulation fluids laden with sharp sand or other proppants are to be pumped into the well during a well stimulation procedure using the BOP protector, the top end box thread 58 of the casing mandrel 50 can be protected from erosion using a high pressure fluid seal for sealing against the secondary seal bore 76 as described in co-applicant's U.S. Pat. No. 6,247,537, which issued on Jun. 19, 2001. One embodiment of the high pressure fluid seal provides an inner wall that extends downwardly past the top end box thread 58 of the casing mandrel 50 to prevent the top end box thread 58 from being "washed out" by the proppants, as shown in FIG. 4*b*.

Figure 5A:
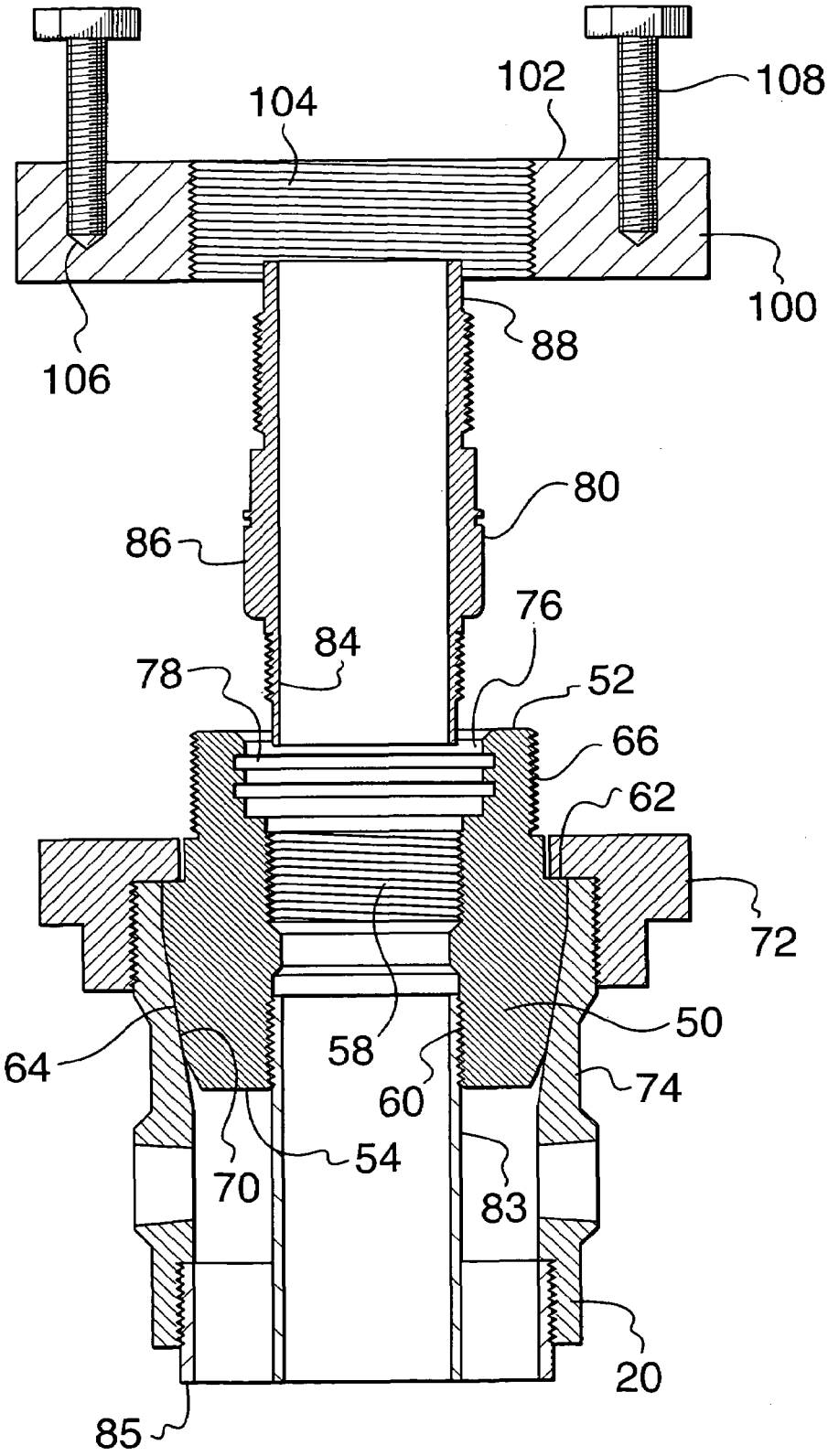
FIG. 5*a* is a partially-exploded schematic cross-sectional view of an adapter including the retainer flange shown in FIG. 4*a*, and the adapter pin shown in FIG. 3.

FIG. 5*a* schematically illustrates the retainer flange 100 in exploded view with the adapter pin 80 and the double-locking casing mandrel 50 of the independent screwed wellhead 20 shown in FIG. 2. Each illustrated component has been described above with reference to a previous drawing, and is indicated by the same reference numeral. The adapter shown in FIG. 5*a* permits coupling of any of a well stimulation tool, a blowout preventer, and a high pressure valve that is configured to receive the top nipple section 88 of the adapter pin 80. It will be appreciated by those skilled in the art that a low profile control stack is advantageous for manipulating equipment, and provides a more sturdy control stack. The retainer flange 100 provides the top surface 102 on a level with the casing mandrel top end 52. An example of the adapter shown in FIG. 5*a* in use is shown in FIGS. 5*b* and 5*c*.

Figure 5B:
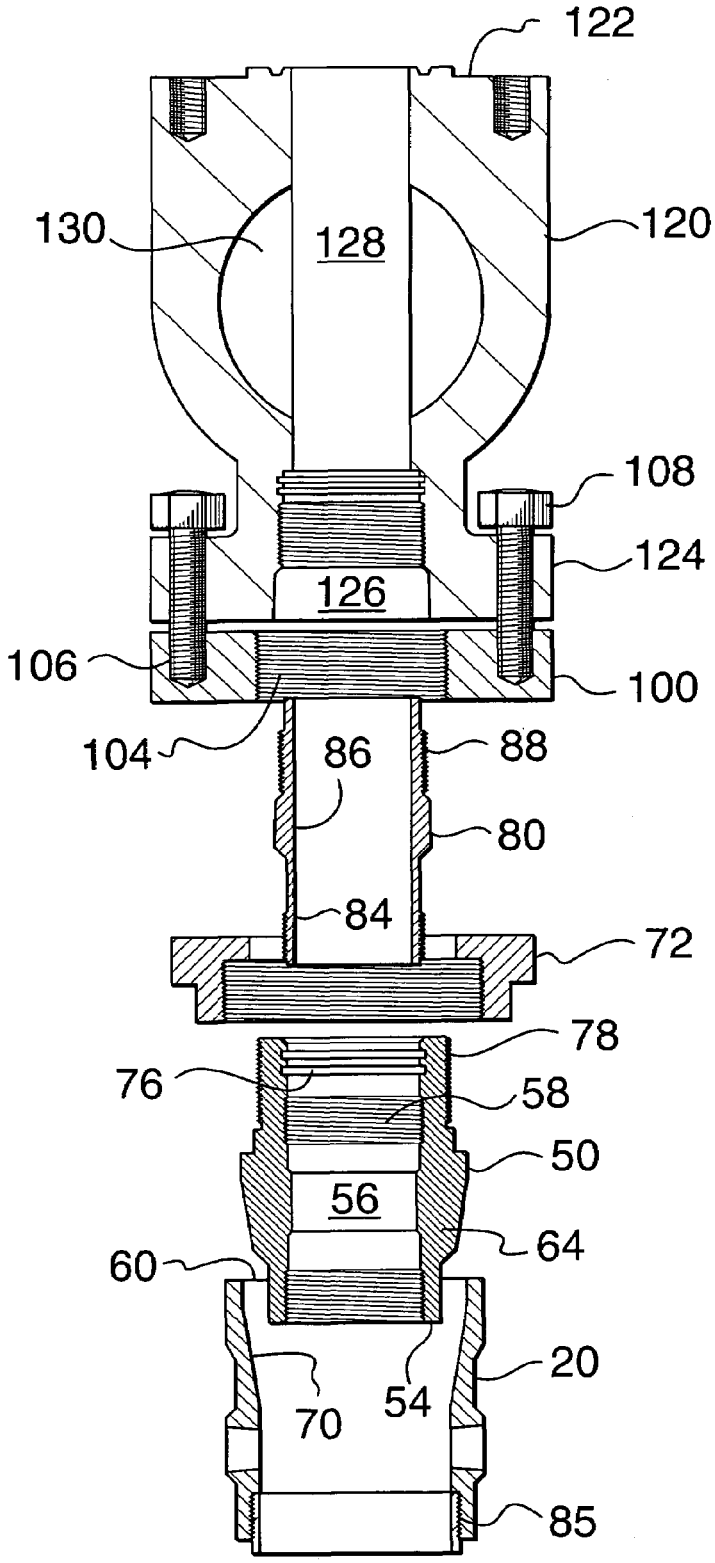
FIG. 5*b* is a schematic exploded cross-sectional view of the adapter shown in FIG. 4*b* supporting a high pressure valve.
Figure 5C:
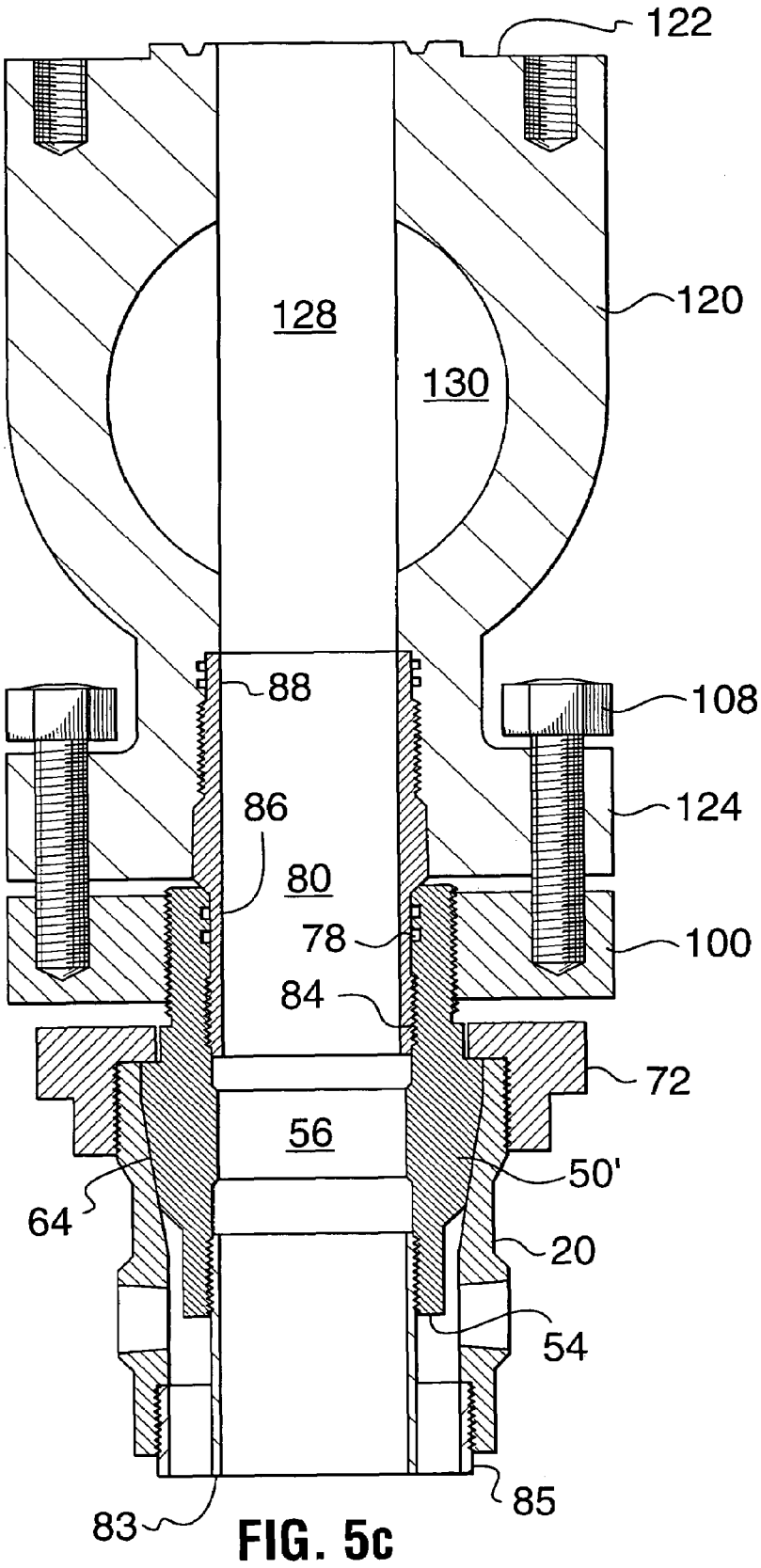
FIG. 5*c* is a schematic cross-sectional view of the adapter shown in FIG. 4*b* supporting the high pressure valve.

FIGS. 5*b,c* schematically illustrate the retainer flange 100 in exploded and cross-sectional views, to which a prior art high pressure valve 120 is mounted. The high pressure valve 120 could be replaced by a blowout preventer (BOP), a well stimulation tool, or the like tool. Components shown in FIGS. 5 and 6 that have been described above are the same reference numerals and those descriptions are not repeated. Since the diameter of the axial passage 104 of the retainer flange 100 is equal to the diameter of the top end of casing mandrel 50, and the adapter pin 80 has a much smaller diameter, the order in which the adapter pin 80 and retainer flange 100 are coupled to the casing mandrel 50' and the high pressure valve 102 is optional. Regardless of the assembly sequence, it is preferable to tighten the studs 108 after the adapter pin 80 is connected to the high pressure valve 120, and to the top end box thread 58 of the casing mandrel 50, and the retainer flange 100 is secured to the casing mandrel 50, so that a tension exerted by the studs 108 locks the box threads 104 of the retainer flange 100 with respect to the pin thread 66 on the outer wall of the casing mandrel 50, while providing a second lock between the high pressure valve 120 and the screwed independent wellhead 20.

The high pressure valve 120 is well known in the art. The high pressure valve 120 has a top flange 122 for connection of other well servicing equipment, such as a well stimulation tool, or a BOP. A bottom flange 124 is bolted to the retainer flange 100. A bottom cavity 126 receives, and threadedly connects to, the top sealing nipple 88 of the adapter pin 80. An axial passage 128 provides a full-bore passage through element 130.

As will be appreciated by those skilled in the art, the illustrated embodiments of the adapters in accordance with the invention provide full-bore access to the casing 83. Consequently, plugs, packers, perforating guns, fishing tools, and any other downhole tool or appliance can be run through the adapter pin 80. In a multi-zone well this permits a rapid transition from the pumping of high pressure well stimulation fluids and other downhole processes, such as the setting of a wireline plug or packer to isolate a production zone; lubricating in a logging tool to locate a production zone; lubricating in a perforating gun to perforate the casing 83 that runs through a production zone; or performing any downhole operation that requires full-bore access to the casing 83 without disconnecting the adapter pin 80 or a BOP mounted to either the top sealing nipple 88 of the adapter pin 80, and the retainer flange 100, or the lockdown flange 82. The lubrication of downhole tools into the well can also be facilitated by use of a reciprocating lubricator as described in co-applicant's U.S. patent application Ser. No. 10/162,803 filed Jul. 30, 2002, the specification of which is incorporated herein by reference. Further speed and economy can be achieved by using an apparatus for perforating and stimulating oil wells as described in co-Applicant's U.S. Pat. No. 6,491,098, which issued on Dec. 10, 2002, the specification of which is also incorporated herein by reference.

The embodiments of the invention described above are intended to be exemplary only. The scope of the invention is therefore intended to be limited solely by the scope of the appended claims.

We claim:

1. An adapter for mounting any one of a blowout preventer, a high pressure valve, and a well stimulation tool to a double-locking casing mandrel of an independent screwed wellhead, the adapter comprising:

an adapter pin comprising a hollow cylindrical body having a central passage, a top nipple section with a top pin thread, and a bottom nipple section with a bottom pin thread and a sealing nipple located above the top pin thread, the bottom nipple section being received in an axial passage of the double-locking casing mandrel and the bottom pin thread engaging a top end box thread in the central passage of the double-locking casing mandrel; and one of:

a lockdown flange comprising a top end to which the blowout preventer, the high pressure valve, or the well stimulation tool can be mounted; the lockdown flange including an axial passage having a box-threaded bottom end for receiving the top nipple section of the adapter pin and threadedly engaging the top pin thread thereof and a lockdown nut supported by an annular shoulder below the top end, the lockdown nut having a box thread for engaging a pin thread on an outer wall of a top end of the double-locking casing mandrel; and a retainer flange for providing a mounting surface to which the any one of the blowout preventer, high pressure valve, and well stimulation tool can be mounted, the retainer flange comprising an annular flange with an axial passageway that is box-threaded for engaging a pin thread on a top end of the double-locking casing mandrel.

2. An adapter for mounting any one of a blowout preventer, a high pressure valve, and a well stimulation tool to a double-locking casing mandrel of an independent screwed wellhead, the adapter comprising:

an adapter pin comprising a hollow cylindrical body having a central passage, a top nipple section with a pin-threaded top end for connection to the blowout preventer, the high pressure valve, or the well stimulation tool, the top nipple section comprising a sealing nipple located above a pin thread on the pin-threaded top end, and a bottom nipple section received in an axial passage in the double-locking casing mandrel with a pin-threaded bottom end for connection to a top box thread in the axial passage of the double-locking casing mandrel; and a retainer flange comprising an annular flange having a top surface to which the any one of the blowout preventer, the high pressure valve, and the well stimulation tool can be mounted, and a box-threaded axial passage for engaging a pin thread on an outer wall of a top end of the double-locking casing mandrel.

3. The adapter as claimed in claim 2 wherein the sealing nipple comprises a smooth, cylindrical outer surface on a top end of the top nipple section, and the cylindrical outer surface mates with O-rings retained in grooves in a central passage of the one of the blowout preventer, the high pressure valve and the well stimulation tool.

4. The adapter as claimed in claim 2 wherein the bottom nipple section of the adapter pin comprises a sealing nipple located between the pin-threaded top end and the pin-threaded bottom end of the adapter pin.

5. The adapter as claimed in claim 4 wherein the sealing nipple comprises a smooth, cylindrical outer surface that mates with O-rings retained in grooves in the axial passage of the double-locking casing mandrel.

6. An adapter for mounting any one of a blowout preventer, a high pressure valve, and a well stimulation tool to a double-locking casing mandrel of an independent screwed wellhead, the adapter comprising:

an adapter pin comprising a hollow cylindrical body having a central passage, a top nipple section with a pin-threaded top end, and a bottom nipple section with a pin-threaded bottom end received in an axial passage of the double-locking casing mandrel for connection to a top box thread in the axial passage of the double-locking casing mandrel; and a lockdown flange having a top end to which any one of the blowout preventer, the high pressure valve, and the well stimulation tool can be mounted; an axial passage having a box-threaded bottom end for receiving the top nipple section of the adapter pin and threadedly engaging the pin-threaded top end of the adapter pin; and a lockdown nut rotatably supported by an annular shoulder located above the bottom end of the adapter pin, the lockdown nut having a box thread for engaging an external pin thread on an outer wall of a top end of the double-locking casing mandrel.

7. The adapter as claimed in claim 6 wherein the box-threaded bottom end of the axial passage of the lockdown flange further comprises:

an annular seal retainer for retaining an elastomeric seal that seals against a smooth cylindrical wall of a sealing nipple on the pin-threaded top end of the adapter pin; and a bottom box thread for engaging a pin thread on the top nipple section of the adapter pin.

8. The adapter as claimed in claim 7 wherein the bottom nipple section of the adapter pin comprises a sealing nipple located above the pin-threaded bottom end of the adapter pin.

9. The adapter as claimed in claim 8 wherein the sealing nipple comprises a smooth, cylindrical outer surface that seals against O-rings retained in grooves in a secondary seal bore of the double-locking casing mandrel.

10. An adapter for connecting to a double-locking casing mandrel of an independent screwed wellhead, the double-locking casing mandrel having a secondary seal bore of greater diameter than a top end box thread of the double-locking casing mandrel, a pin thread on a top outer wall, and an annular groove on a top lip between the secondary seal bore and the top outer wall; the adapter comprising:

an adapter pin comprising a hollow cylindrical body having a central passage, a top nipple section with a pin-threaded top end and a sealing nipple located above a pin thread on the pin-threaded top end, and a bottom nipple section with a pin-threaded bottom end received in an axial passage of the double-locking casing mandrel for connection to a top box thread in the axial passage of the double-locking casing mandrel; and a retainer flange having threaded bores spaced circumferentially about a box-threaded axial passage for securing any one of a blowout preventer, a high pressure valve, and a well stimulation tool to the retainer flange, wherein the box-threaded axial passage engages a pin thread on a top end of an outer wall of the double-locking casing mandrel, the box-threaded axial passage having a diameter equal to the diameter of a top outer wall of the double-locking casing mandrel.

11. A method for stimulating a well equipped with a double-locking casing mandrel of an independent screwed wellhead, comprising:

sealingly connecting to the double-locking casing mandrel an adapter pin that comprises a hollow cylindrical body with an internal diameter at least as large as that of a casing of the well supported by the double-locking casing mandrel, by thread-engaging rotation of a pin-threaded nipple section of the adapter pin with respect to a top end box thread of the double-locking casing mandrel;

threadedly connecting a retainer flange to a pin thread on an outer wall of a top end of the double-locking casing mandrel;

securing well stimulation equipment to the double-locking casing mandrel using a pin-treaded top end of the adapter pin, the pin threaded top end including a sealing nipple having a smooth cylindrical outer surface that mates with elastomeric seals retained in grooves in a central passage of the well stimulation equipment, and box threaded bores in a top surface of the retainer flange for receiving flange bolts; and stimulating the well by pumping high pressure well stimulation fluids through the well stimulation equipment into the casing of the well.

12. The method as claimed in claim 11 wherein the step of securing comprises rotating any one of a well stimulation tool, a blowout preventer, and a high pressure valve into connection with the pin-threaded top end, and then bolting the one of the well stimulation tool, blowout preventer, and high pressure valve to the top surface of the retainer flange.

13. The method as claimed in claim 11 wherein the step of securing comprises mounting a blowout preventer to the retainer flange, mounting a blowout preventer protector to the blowout preventer, and stroking the blowout preventer protector through the blowout preventer and into a secondary seal bore of the double-locking casing mandrel prior to stimulating the well.

14. The method as claimed in claim 13 wherein the step of securing comprises mounting a high pressure valve above the blowout preventer.

15. The method as claimed in claim 14 further comprising connecting high pressure fracturing lines to the high pressure valve to permit the high pressure well stimulation fluids to be pumped into the casing of the well.

16. A method for stimulating a well equipped with a double-locking casing mandrel of an independent screwed wellhead, comprising:

sealingly connecting both the double-locking casing mandrel and a lockdown flange to an adapter pin that has an internal diameter at least as large as a casing of the well connected to a bottom end of the double-locking casing mandrel;

threadedly connecting a lockdown nut of the lockdown flange rotatably supported by an annular shoulder below a top end of the lockdown flange, to a pin thread on an outer wall of a top end of the double-locking casing mandrel;

mounting well stimulation equipment to a top surface of the lockdown flange; and stimulating the well by pumping high pressure well stimulation fluids through the well stimulation equipment and into the casing of the well.

17. The method as claimed in claim 16 wherein mounting the well stimulation equipment comprises mounting any one of a well stimulation tool, a blowout preventer, and a high pressure valve in a sealed connection to the lockdown flange.

18. The method as claimed in claim 17 wherein mounting the well stimulation equipment comprises mounting the blowout preventer, and further comprises mounting a blowout preventer protector and stroking the blowout preventer protector through the blowout preventer, and packing off the blowout preventer protector against a secondary seal bore of the double-locking casing mandrel.

19. The method as claimed in claim 17 wherein mounting the well stimulation equipment comprises mounting the blowout preventer, and further comprises mounting a high pressure valve above the blowout preventer.

20. The method as claimed in claim 16 wherein one of a well stimulation tool and a high pressure valve is mounted above the retainer flange and mounting the well stimulation equipment further comprises:

mounting a high pressure valve to the one of the well stimulation tool and the blowout preventer; and connecting high pressure fracturing lines to the high pressure valve to permit the well stimulation fluids to be pumped into the casing of the well.

21. A method for stimulating a well equipped with a double-locking casing mandrel of an independent screwed wellhead, comprising:

threadedly connecting a retainer flange to a pin thread on an outer wall of a top end of the double-locking casing mandrel using an adapter pin comprising a hollow cylindrical body having a central passage, a top nipple section with a pin-threaded top end and a sealing nipple located above a pin thread of the pin threaded top end, and a bottom nipple section with a pin-threaded bottom end received in an axial passage of the double-locking casing mandrel for connection to a top box thread in the axial passage of the double-locking casing mandrel;

mounting well stimulation equipment having an internal diameter at least as large as that of the double-locking casing mandrel, to a top of the retainer flange in sealed connection with a top of the double-locking casing mandrel and threadedly engaging the well stimulation equipment with a pin thread on the pin-threaded top end of the adapter pin; and completing the well by pumping high pressure well stimulation fluids through the well stimulation equipment into a casing of the well.

22. The method as claimed in claim 21 wherein mounting the well stimulation equipment comprises mounting at least one of a well stimulation tool, a blowout preventer (BOP), and a high pressure valve in sealed connection with the top of the double-locking casing mandrel.

23. The method as claimed in claim 21 wherein mounting the well stimulation equipment comprises mounting a blowout preventer to the retainer flange, and mounting a BOP protector to the blowout preventer and stroking the BOP protector through the blowout preventer, and packing off the BOP protector against a secondary seal bore of the double-locking casing mandrel.

24. The method as claimed in claim 23 wherein mounting the well stimulation equipment further comprises mounting a high pressure valve to a top of the blowout preventer protector.

25. The method as claimed in claim 21 wherein mounting the well stimulation equipment further comprises:

mounting a high pressure valve to the retainer flange; and connecting high pressure fracturing lines to the high pressure valve to permit the well stimulation fluids to be pumped into the casing of the well.

* * * * *

UNITED STATES PATENT AND TRADEMARK OFFICE

CERTIFICATE OF CORRECTION

PATENT NO. : 7,040,410 B2
APPLICATION NO. : 10/617099
DATED : May 9, 2006
INVENTOR(S) : Bob McGuire and L. Murray Dallas It is certified that error appears in the above-identified patent and that said Letters Patent is hereby corrected as shown below:

Column 4, line 63, please delete “at” and replace with --as--.

Column 11, line 2, please delete “pin-treaded” and replace with --pin-threaded--.

Signed and Sealed this

Sixth Day of May, 2008

JON W. DUDAS
*Director of the United States Patent and Trademark Office*